United States Patent [19]

Martinez

[11] 4,055,231

[45] Oct. 25, 1977

[54] SILENCER FOR INTERNAL COMBUSTION ENGINES

[76] Inventor: Ginez Martinez, 153, rue Anatole France, 93130 Noisy le Sec, France

[21] Appl. No.: 622,116

[22] Filed: Oct. 14, 1975

[30] Foreign Application Priority Data

Oct. 14, 1974 France ..... 74.35358
Oct. 8, 1975 France ..... 75.30835

[51] Int. Cl.[2] ..... F01N 1/08; F01N 7/18; F01N 3/06

[52] U.S. Cl. ..... 181/241; 181/256; 181/264; 181/282

[58] Field of Search ..... 181/36 B, 49, 57, 59, 181/61, 64 B, 67

[56] References Cited

U.S. PATENT DOCUMENTS

| | | | |
|---|---|---|---|
| 1,087,397 | 2/1914 | Persson | 181/49 |
| 2,131,001 | 9/1938 | Prochnow | 181/59 |
| 2,718,273 | 9/1955 | Dehaus | 181/36 B |
| 2,770,313 | 11/1956 | Johnson | 181/36 B |
| 3,115,210 | 12/1963 | Birk | 181/57 |
| 3,253,676 | 5/1966 | Bottum | 181/57 |
| 3,903,928 | 9/1975 | Sykes et al. | 181/36 B |

*Primary Examiner*—Stephen J. Tomsky
*Attorney, Agent, or Firm*—Cushman, Darby & Cushman

[57] ABSTRACT

The application discloses a new silencer for internal combustion engines. This silencer comprises an internal resilient tube capable to vibrate longitudinally and permeable to the exhaust gas and an external sheath. An end piece closes the internal tube. Spacers are secured to the internal tube and another end piece provided with apertures is secured to the end of the external sheath. The exhaust gases exit from the internal tube through the space comprised between the spacers and the external sheath towards said apertures in the other end piece.

6 Claims, 6 Drawing Figures

SILENCER FOR INTERNAL COMBUSTION ENGINES

BACKGROUND OF THE INVENTION

The invention relates to a new and improved silencer for internal combustion engines and more specifically, but not only, for engines as used in lawn-mowers or chain-saws.

It is known in the art that the engines of lawn-mowers or chain-saws have a noisy gas exhaust, which is most undesirable as those engines are generally used in places where people expect calm and silence. The mufflers which are commonly used in such engines of course reduce the noise which would result from a free exhaust, ; however, the noise level remains very high at the output of those classical mufflers.

SUMMARY OF THE INVENTION

An object of the invention is to overcome this drawback by providing a silencer which offers little obstruction to the free passage of the gas and is easy and inexpensive to manufacture.

Another object of the invention is to provide a silencer which has a settable frequency attenuation range.

Another object of the invention is to provide a silencer which is flexible.

In order to achieve these objects and others, a silencer according to the invention comprises two concentric tubes.

The first tube, connected with the exhaust manifold of the engine, is flexible and very "supple", that is easily capable to vibrate in the axial direction in response to the pulsations of the gas incoming therein, and is also permeable to the exhaust gas to be evacuated. The second tube or external sheath is substantially not supple, that is little liable to vibrate and is substantially not permeable to the exhaust gas. This external sheath is preferentially flexible. An end piece is secured to the end of the internal tube opposite to the engine exhaust, in order to occlude said end. Another end piece is also secured to the end of the external sheath opposite to the engine exhaust, said end piece being provided with holes, the shape, the size or the width of which can be ajusted and through which the gas exhausts from the silencer. The concentric relationship between the internal and external tubes is substantially provided by means of disk shaped spacers, secured to the internal tube and eventually capable to slide with respect to the external tube, said spacers being permeable to the exhaust gas which can accordingly pass from the internal tube to the external tube and through the spacers towards the exhaust gas output.

BRIEF DESCRIPTION OF THE DRAWINGS

Those objects, features and advantages and others of the instant invention will be explained in details in the following description of preferred embodiments, made in connection with the attached drawings, wherein.

DESCRIPTION OF THE PREFERRED EMBODIMENTS

Figure 1:
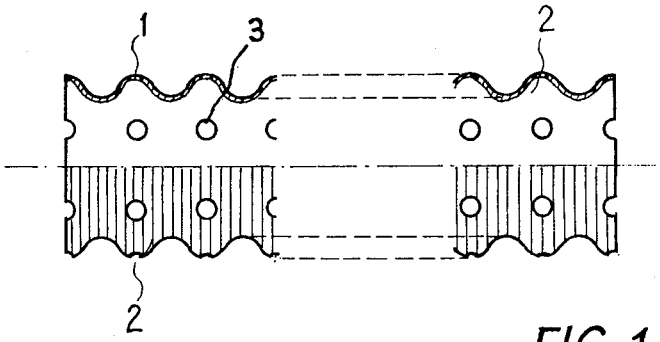
FIG. 1 is a partial longitudinal view of an embodiment of an internal tube according to the invention.

According to the invention, the silencer for an internal combustion engine comprises a tube 1 which is resilient in its axial direction. Various means can be used for obtaining a tube resilient in its axial direction. In the example of FIG. 1, the wall of the tube 1 is corrugated and forms parallel corrugations 2 which permit the tube — by the resilience of the material constituting same — to vibrate longitudinally and locally with the pulsations of the exhaust gas. Said tube is provided with perforations 3 or is made of a material permeable to the exhaust gas.

While any internal tube which is flexible, supple, liable to vibrate longitudinally, permeable to the gas and of a material which is not quickly damaged by the exhaust gas can be used according to the invention, and the external sheath can be of any material which permits said sheath to be flexible, without giving it the capacity to vibrate longitudinally and to be permeable to the gas, it will be disclosed hereinafter a preferred embodiment of the invention wherein the internal tube and the external sheath are made by winding a continuous strip of metal around a mandrel, the cross sectional form of the strip being suitably chosen. Such helical windings of metallic strips are not novel per se. They are in particular used in electrical equipments as electrical sheaths.

Figure 2A:
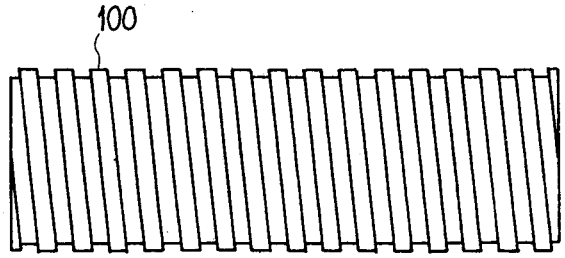
FIG. 2A shows another embodiment of an internal tube according to the invention.
Figure 2B:
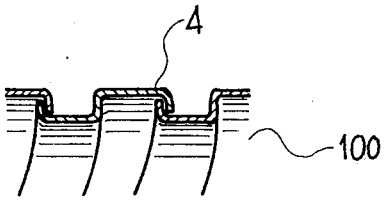
FIG. 2B shows a partial longitudinal section of the internal tube of FIG. 2A.

FIGS. 2A and 2B respectively show a front view and a partial longitudinal section of a tube 100, of the electrical sheath type, adapted to be used as an internal tube according to the invention. The thickness of the strip and the type of the strip material are such as the elementary whorls can easily slide with respect to each others and the gas can easily escape through the interstices of the helical winding. The ⊔-shape shown in FIG. 2B is specifically adapted to provide the requested appropriate supple and permeable characteristics. In FIG. 2B the reference 4 shows the strip. The helical tube 100 has a high longitudinal resilience.

Figure 3:
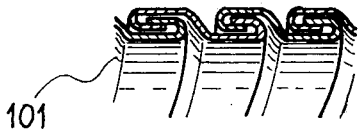
FIG. 3 shows a partial longitudinal section of an embodiment of external sheath used in the instant invention.

FIG. 3 shows a partial longitudinal section of a tube adapted to be used as an external sheath according to the invention. A specific shape for the wound strip is shown in FIG. 3. It will be appreciated that this shape permits to obtain a flexible tube which is little liable to vibrate or to let the gas pass through. However, other shapes providing the same result can be used.

Figure 4:
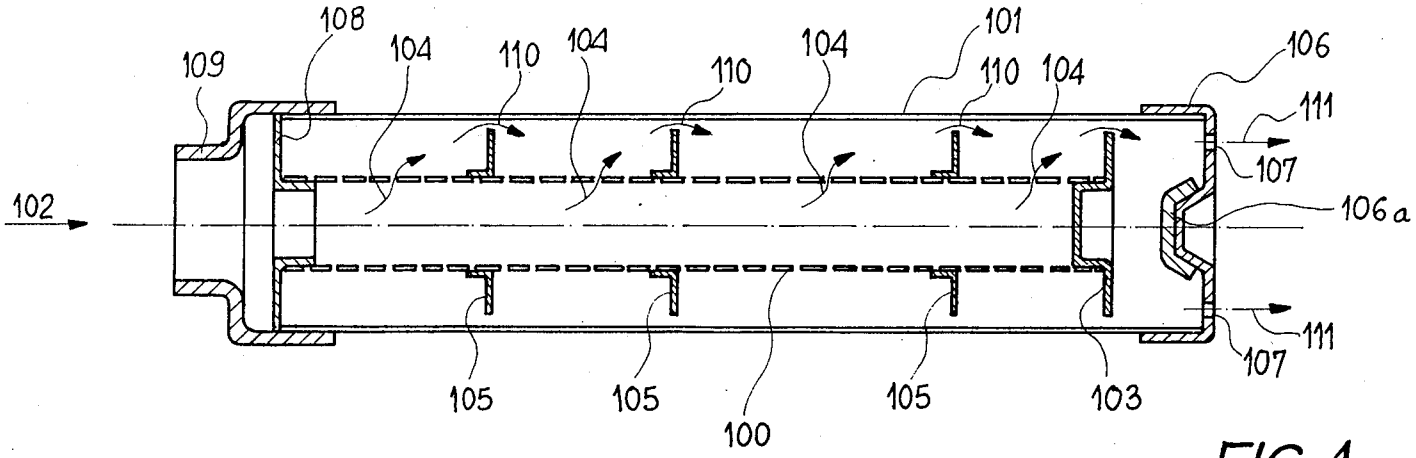
FIG. 4 shows an embodiment of a silencer according to the invention.

FIG. 4 is a schematical view showing a silencer according to the instant invention. This silencer comprises an internal tube 100 for example as shown in FIGS. 2A and 2B, and an external tube 101, for example such as partially shown in FIG. 3. For the sake of simplicity, those internal and external tubes have been very schematically shown. In particular, the dashed lines showing the internal tube 100 do not correspond to the width of the elementary strip but only symbolize the permeable character of the internal tube.

Figure 5:
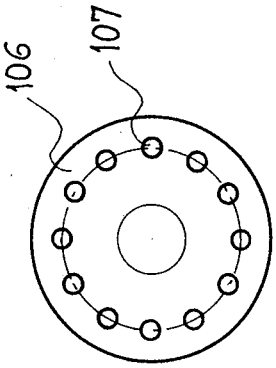
FIG. 5 shows a front view of an embodiment of the end piece of the external sheath shown in section in FIG. 4.

The exhaust gases enter the internal tube 100 according to the direction of the arrow 102. The internal tube 100 is occluded at its end opposite to the gas inlet by the end piece 103. This is one of the important features of the instant invention and it results therefrom that the exhaust gases go out of the internal tube only through the walls thereof, to be directed as indicated by the arrows 104 towards the annular space comprised between the internal tube 100 and the external sheath 101. Washers 105 are secured to the internal tube 100 by any suitable means such as fitting, welding or threading on the outer corrugations of the internal tube, as shown in FIG. 2. The external sheath is provided with an end piece 106 which can be secured or not to the end piece 103 of the internal tube. As shown in FIG. 5, said end piece 106 is provided with apertures 107 having any desired shape. A damping material 106a can also be provided, secured to the central section of the end piece 106 on the internal side thereof, in order to damp shocks on the end piece 103 of the internal tube 100 against the end piece 106 of the external sheath 101 when the internal tube 100 vibrates.

On the inlet side of the exhaust gases in the silencer an assembly of parts is provided such as the parts 108 and 109 for permitting, on the one hand, the exhaust gases to enter the internal tube and not directly the external sheath — this is the aim of the part 108 in FIG. 4 — on the other hand, to secure the silencer according to the invention to the exhaust manifold of the internal combustion engine, the noise of which is to be attenuated — this is the function of the part 109. Various embodiments of this assembly of parts 108 and 109 can be achieved by those skilled in the art.

For example, on the engine side, the securing part 109 can be inwardly or outwardly threaded, depending whether this part has to be threadedly engaged inside or outside the exhaust manifold of the engine respectively. As those exhaust manifolds do not usually comprise any threading, the securing part 109 is advantageously provided with a tapered end acting as a die or tap borer and comprising recesses, this tapered end permitting to obtain the desired thread at the output of the exhaust manifold. Of course, in this case, the parts 109 will be made of a suitable material such as heat-treated steel for obtaining said threadings.

The securing part 109 can also be tightened on the exhaust manifold and, in particular, can be made of a heatshrinkable material. An insulating coupling can be arranged inside the part 109 for avoiding the effects of the high temperature of the exhaust gas.

Thus, the gas streams exiting according to the arrows 104 towards the space between the internal tube and the external sheath will be directed according to the arrows 110 through the permeable washers 105 towards the output of the silencer as shown by the arrrows 111.

A theoretical explanation of the silencer according to the invention cannot be presently provided by the Applicant. It can be assumed that the spaces between the washers 105 operate as partial expansion chambers and that the portions of the supple tube 100 between those washers vibrate in a substantially independent manner. The Applicant has experimentally found that by modifying the positions of the washers with respect to the internal tube 100, it is possible to highly attenuate given frequencies of the emitted acoustic spectrum. It is accordingly possible to modify the silencer according to the invention for a specific type of engine, according to the acoustic frequencies emitted. Another means for achieving such an adjustment stands in the selection of the apertures 107 of the end piece 106. For example, in the illustrated embodiment experiments have shown that, accluding a given number of the apertures 107, for example by means of screws if said apertures are threaded, modifies the acoustic spectrum of the silencer.

As it will be apparent from the above explanations, the washers 105 permit the gas to pass from the annular space comprised between the internal tube and the external sheath towards the output apertures 107 of the part 106. Those washers can be cut-out, star-shaped, or of any other suitable shape or type. The washers 105 are secured to the internal tube and can slide with a more or less important friction factor with respect to the inside wall of the external sheath. The choice of this friction factor constitutes another means for modifying the acoustic response frequency spectrum of the silencer according to the invention.

Experiments made by the Applicant have shown that according to the size of the gas path through the washers or between the washers and the external tube, different noise-reductions are obtained. This is yet another means for adjusting the acoustic frequency spectrum of the silencer according to the invention.

One important advantage of the silencer according to the invention over the silencers known in the art having an open output for the exhaust gas is the following : with prior art devices having an open output, one of the main means for improving the noise reduction consists in increasing the length of the silencer. On the contrary, according to the invention, experiments have shown that for a silencer adapted to a chain-saw engine, silencers having a length of 25, 50, 75 and 100 cm give substantially the same results and moreover, surprisingly, the silencer having a length of 25 cm gives a better result for some frequencies. Accordingly, the silencer according to the invention may be very efficient even with a short length.

Additionally, it has surprisingly been noted that the occlusion of the end of the internal tube opposite to the inlet of the exhaust gas therein does not cause a net reduction of the efficiency of the engine, if, of course, the permeability of the tube is great enough, that is, in the preferred embodiment, the strip forming the internal tube is chosen and wound in order that the interstices which occur during the vibrations and at rest permit a sufficient escape for the exhaust gases.

Various variants and modifications may be provided without departing from the scope of the instant invention. For example, a plurality of devices according to the invention can be arranged in parallel, each one receiving a part of the exhaust gas from an internal combustion engine. The internal tube can comprise successive tube portions secured to each other for example by the washers 105. Said tube portions can have different longitudinal resiliences.

The resilient internal tube and the external sheath are made of any material withstanding the temperature due to the exhaust gas. The tube and the sheath can be made of metal or of a heat-resistant plastic material.

The noise reduction obtained with the silencer according to the invention is very important. For example, with a background noise of 52 to 54 decibel, and a lawn-mower engine having a noise of 72dB, the use of a silencer according to the invention reduces the noise to 58 dB, that is only a little more than the background noise.

EXAMPLE

A silencer of the type shown in FIGS. 2, 3 and 4, but wherein the end parts 103 and 107 constitute a single part, has been mounted by the Applicant, with the following features, the units being in mm :

Internal tube 100 :
- metal thickness : 0.25
- internal diameter : 15.5
- external diameter : 18.5
- internal radius of curvature : 3.5
- helical pitch : 5.5

Spacers 105 :
- number : 3
- shape : washers with flat portions
- thickness : 3
- clearance with respect to the external sheath : 0.2

External sheath 101 :
- metal thickness : 0.3
- internal diameter : 2.5
- external diameter : 27.3
- internal radius of curvature 85
- helical pitch : 6.5

Total length of the silencer : 250

Performances with a two-stroke engine; capacity 32cm³; P = 3.5 HP; maximum rotational speed 12,000 *t*/min :

| | low rate (dB) | | | rated burden (dB) | | |
|---|---|---|---|---|---|---|
| gas exhaust | A | B | C | A | B | C |
| without silencer | 79 | 82 | 83 | 101 | 102 | 104 |
| classical silencer | 65 | 70 | 73 | 90 | 93 | 95 |
| silencer according to the invention | 58 | 61 | 68 | 80 | 82 | 84 |
| ambient noise level | 50 | 57 | 64 | 50 | 58 | 64 |

A = acute
B = 10 medium
C = bass rated burden : 7000 to 9000 turns/min.

The noise attenuation has not been substantially improved with similar silencers having length from 500 to 1000 mm.

The present invention is not limited to the embodiments which have been disclosed and other variants and modifications may be provided without departing from the scope of the invention.

In particular, the internal tube and external sheath may have any desired shape other than circular, for example elliptical, rectangular, etc.

What is claimed is:

1. A silencer for an internal combustion engine, comprising:

a supple resilient internal tube, adapted to vibrate longitudinally under the influence of the exhaust gas and permeable to said gas, receiving the exhaust gas from said engine;

an elastic external sheath which is substantially not supple and not adapted to vibrate longitudinally and substantially not permeable to the gas, said sheath being substantially coaxial with the internal tube;

an end piece closing the internal tube at the end opposite to the inlet of the exhaust gas therein;

washers or spacers slideably secured to the internal tube at irregular intervals and permitting the gas to pass in the annular space comprised between the washers or spacers and the external sheath;

an end piece secured to the end of the external sheath opposite to the inlet of the gas and provided with apertures for the output of the exhaust gas; and an expansion chamber between the end piece closing the internal tube and the end piece secured to the end of the external sheath.

2. A silencer according to claim 1, wherein means are provided for partially occluding the apertures of said end piece of said external sheath, whereby the acoustic frequency spectrum of the silencer is adjustable.

3. A silencer according to claim 1 wherein the internal tube is constituted of an helical winding of a metallic strip, said strip being shaped in order that the tube is capable to vibrate longitudinally and the exhaust gas can escape through the interstices of the winding, as shown in FIG. 2B.

4. A silencer according to claim 1, wherein the external sheath is constituted of an helical winding of a metallic strip, said strip being so shaped that it is substantially not permeable to the gas and substantially not liable to vibrate longitudinally, as shown in FIG. 3.

5. A silencer according to claim 1, including a damping material secured to a central interior portion of said end piece secured to the end of the external sheath, whereby shocks on said end piece are damped.

6. A silencer according to claim 1, including at least three washers or spacers slideably secured to the internal tube at irregular intervals.

* * * * *